US009604827B2

(12) United States Patent
Azzarelli

(10) Patent No.: US 9,604,827 B2
(45) Date of Patent: Mar. 28, 2017

(54) MOBILE WINCH IN A BAG SYSTEM

(71) Applicant: John Azzarelli, Bamberg, SC (US)

(72) Inventor: John Azzarelli, Bamberg, SC (US)

( * ) Notice: Subject to any disclaimer, the term of this patent is extended or adjusted under 35 U.S.C. 154(b) by 16 days.

(21) Appl. No.: 14/624,822

(22) Filed: Feb. 18, 2015

(65) Prior Publication Data

US 2016/0236921 A1 Aug. 18, 2016

(51) Int. Cl.

| | |
|---|---|
| ***B66D 3/20*** | (2006.01) |
| ***B66D 1/12*** | (2006.01) |
| ***B66D 3/00*** | (2006.01) |
| ***B65D 85/04*** | (2006.01) |
| ***B65H 49/32*** | (2006.01) |
| ***B66D 3/26*** | (2006.01) |

(52) U.S. Cl.

CPC ..... *B66D 3/20* (2013.01); *B65D 85/04* (2013.01); *B65H 49/322* (2013.01); *B66D 1/12* (2013.01); *B66D 3/006* (2013.01); *B66D 3/26* (2013.01)

(58) Field of Classification Search

CPC ..... B65H 49/322; B65H 55/046; B65H 2701/533; B65D 85/04; B65D 1/12; B65D 3/20

See application file for complete search history.

(56) References Cited

U.S. PATENT DOCUMENTS 484,042 A * 10/1892 Murphy et al. ..... A62B 1/10 182/240
1,990,135 A * 2/1935 Sato ..... B65H 49/205 224/162
3,150,769 A * 9/1964 Cohn ..... B65D 85/04 220/642
3,788,605 A * 1/1974 Johnson ..... B66D 1/00 251/166
3,802,511 A * 4/1974 Good, Jr. ..... B05B 9/0855 169/30
4,196,889 A * 4/1980 Dudek ..... B66D 3/00 254/344
4,623,124 A * 11/1986 Lewis ..... B66D 1/08 254/350
4,771,889 A * 9/1988 Bauer ..... B65D 85/671 206/390
5,054,745 A * 10/1991 Swayze ..... B66D 3/046 242/390.7
5,350,186 A * 9/1994 Hull ..... B60D 1/185 242/379.2
5,464,049 A * 11/1995 Cullen ..... A01F 25/14 141/114
5,474,278 A * 12/1995 Cleveland ..... B66D 1/00 224/153

(Continued)

*Primary Examiner* — Emmanuel M Marcelo
*Assistant Examiner* — Michael Gallion
(74) *Attorney, Agent, or Firm* — Southeast IP Group, LLC.; Thomas L. Moses; Randolph J. Tucker

(57) ABSTRACT

A mobile winching system is provided, whereby a motorized winch, battery, and controller are mounted on a metal plate that is attached to and may be enclosed within a bag, wherein the metal plate has attachment points for coupling an anchor component to fix the winch system in position during a winching operation. The mobile winch in a bag system provides a way to transport and operate a winch in areas that are otherwise inaccessible by traditional vehicle mounted winches without the necessity of separately transporting the components of the system and with reduced setup of the components for use.

8 Claims, 3 Drawing Sheets

(56) References Cited

U.S. PATENT DOCUMENTS 5,522,582 A * 6/1996 Dilks ..... B66D 1/00 242/587.2
5,573,091 A * 11/1996 Hung ..... B66D 1/16 192/12 D
5,593,139 A * 1/1997 Julian ..... B60R 9/06 224/521
5,607,143 A * 3/1997 Regal ..... B66D 1/04 254/342
5,842,684 A * 12/1998 Aho ..... B66D 1/08 254/323
5,876,019 A * 3/1999 Morrissey, Jr. ..... B66D 1/28 254/323
5,979,812 A * 11/1999 Kotzur ..... B65H 57/12 206/409
6,138,992 A * 10/2000 Bell ..... B66D 1/00 224/519
6,145,780 A * 11/2000 Fontana ..... B65H 49/24 242/400
6,186,283 B1 * 2/2001 Luker ..... B60T 3/00 188/32
6,193,095 B1 * 2/2001 McNeil ..... B65F 1/062 220/495.07
6,241,215 B1 * 6/2001 Gersemsky ..... A61G 7/1015 254/342
6,276,623 B1 * 8/2001 Williams ..... B65H 57/12 206/395
6,294,759 B1 * 9/2001 Dunn, Jr. ..... B23K 3/00 206/373
6,494,437 B1 * 12/2002 Boyer ..... B08B 9/0436 212/232
6,595,490 B1 * 7/2003 Harrah ..... B66F 1/06 242/392
6,601,743 B2 * 8/2003 Godshaw ..... A45C 9/00 190/113
6,790,403 B1 * 9/2004 Priedeman, Jr. ..... B29C 41/36 264/308
6,966,791 B1 * 11/2005 Farr ..... B65H 75/406 206/303
7,320,445 B2 * 1/2008 Eastwood ..... B65H 49/322 242/588.6
7,344,120 B2 * 3/2008 McFarland ..... B66D 1/00 224/511
7,350,769 B1 * 4/2008 Dorzok ..... A01M 31/02 248/219.1
7,455,257 B1 * 11/2008 Kaleta ..... B63C 11/02 242/397.3
7,458,563 B1 * 12/2008 Liu ..... A01M 31/02 254/334
7,469,881 B2 * 12/2008 Alipour ..... B66C 1/10 254/272
7,861,829 B1 * 1/2011 Coursey ..... B60T 1/062 188/31
7,913,978 B1 * 3/2011 Trihey ..... B66D 1/36 254/323
8,006,840 B2 * 8/2011 Babcock ..... B65H 55/046 206/395
8,006,958 B2 * 8/2011 Starks ..... B66D 3/20 254/323
8,196,980 B1 * 6/2012 Banks ..... A01K 23/005 294/1.3
8,251,212 B2 * 8/2012 Dunlap ..... B65D 85/04 206/403
8,328,530 B2 * 12/2012 Fronzoni ..... F04B 17/03 224/153
8,418,659 B2 * 4/2013 Harruna ..... A01K 27/004 119/796
8,434,742 B2 * 5/2013 Akhavein ..... B66D 3/006 254/344
8,944,358 B2 * 2/2015 Copp ..... B65H 55/046 206/409
8,960,431 B2 * 2/2015 Copp ..... B65D 85/04 206/395
9,050,788 B2 * 6/2015 Swanson ..... B29C 67/0055
9,061,814 B2 * 6/2015 Copp ..... B65D 85/04
9,241,496 B2 * 1/2016 Thickey ..... A22B 5/00
9,284,170 B2 * 3/2016 Guimaraes ..... B66D 1/28
9,315,316 B2 * 4/2016 Babcock ..... B65D 85/04
9,463,965 B2 * 10/2016 Heravi ..... B66D 3/20
2002/0125161 A1 * 9/2002 Cote ..... B65D 5/5014 206/408
2003/0005813 A1 * 1/2003 Villanueva ..... B65D 85/04 84/453
2003/0085080 A1 * 5/2003 Glassey ..... B66B 7/062 187/411
2003/0136870 A1 * 7/2003 Braun ..... A62B 1/06 242/360
2005/0017117 A1 * 1/2005 Moon ..... B65H 75/403 242/390.8
2005/0072965 A1 * 4/2005 Sanders ..... B66D 1/485 254/361
2009/0260922 A1 * 10/2009 Marquardt ..... A62B 1/10 182/232
2010/0006692 A1 * 1/2010 Galgano ..... B62B 1/14 242/588.4
2010/0283172 A1 * 11/2010 Swanson ..... B29C 67/0055 264/80
2010/0314484 A1 * 12/2010 Houston ..... A45C 3/00 242/588.3
2010/0320310 A1 * 12/2010 McManus ..... B65D 5/5052 242/588.3
2011/0248228 A1 * 10/2011 Gause ..... B66D 3/006 254/323
2012/0006284 A1 * 1/2012 Messner ..... A01K 27/004 119/796
2013/0161432 A1 * 6/2013 Mannella ..... B65H 57/12 242/171
2013/0161442 A1 * 6/2013 Mannella ..... B29C 67/0055 242/598
2015/0090946 A1 * 4/2015 Schwaiger ..... B66D 3/26 254/362
2015/0365756 A1 * 12/2015 Merenda ..... H04R 1/1033 381/375
2016/0068378 A1 * 3/2016 Copin ..... B66D 3/20 254/385

* cited by examiner

MOBILE WINCH IN A BAG SYSTEM

BACKGROUND OF THE INVENTION

The present invention generally relates to a mobile winching system whereby a motorized winch and power source are mounted to a metal plate that is secured inside a carrying bag or other similarly bag-shaped enclosure. This mobile winch in a bag system provides a way to easily transport and operate a winch in areas that are otherwise inaccessible by traditional vehicle-mounted winches and situations where carrying multiple separate components would be inconvenient.

A winch is a mechanical device commonly used for lifting or pulling loads by means of a rope or cable that is wound around a cylinder turned by an engine, a motor, or by hand. A winch is typically comprised of a bi-directional motor, which drives a cable drum around which a cable is wrapped. One end of the cable is secured to the drum while the free end of the cable includes a hook or other hook-like device. A typical winch has a cable made of wound metal strands, rope, chain, or other similar material having high tensile strength wound around the drum. Thus when the motor turns in one direction, the cable can be fed outwardly, and conversely, while the motor turns in the opposite direction, the cable is pulled inwardly, creating a pulling force on the cable and the hook.

A winch may be used in situations where a pulling force on an item is required and the winch is relatively fixed with respect to another object. Typically, a winch can be attached to a vehicle such as all terrain vehicle (ATV), snowmobile, four-wheel drive vehicle and the like. The winch can be used in a variety of ways to provide assistance to the vehicle driver. For example, one end of the cable may be attached to a stationary object and the winch used to help move or extricate the vehicle from a stuck position. Additionally, one end of the cable may be attached to an object in order to hoist or haul it, or to remove an obstacle from the road in order for the vehicle to pass. Additionally, a winch may be used in tree rigging and removal whereby the winch is attached to a tree to facilitate pulling the tree in the desired direction in which to fall.

While the vehicle mounted winch has multiple attributes, the shortcoming is that the winch is permanently coupled to the vehicle, and the winch can only be used in conjunction with the vehicle, or where the vehicle may maneuver. Moreover, as the winches are hardwired and powered by the vehicle's battery, extended use of the winch can reduce vehicle battery voltage to below starting requirements and may strand the operator without sufficient battery power.

While a person could transport a winch and power source separately to a location where a wench is necessary but inconvenient to take a vehicle mounted winch, the shortcoming is that transporting, assembling, using, and disassembling such a system is an inconvenience. Moreover, even if all of these components were transported together in an enclosure, they would require removal and setup before use.

Therefore, it would be desirable to provide a convenient, portable system and method of operating a winch in areas inaccessible by current vehicle-mounted winches that reduces the inconvenience of separate transport or setup of the components. Additionally, having an independent power source operating the winch avoids the problem of draining a vehicle battery. Further, it would be desirable to provide a small winch system that may be easily moved and handled by a single person, and which would be particularly useful for logging operations and other types of jobs that are necessarily located in remote places that provide challenges for positioning a vehicle with a mounted winch.

SUMMARY OF THE INVENTION

In accordance with one aspect of the invention, a mobile winch system in a bag shaped enclosure is provided. The winch system, in a preferred embodiment, generally comprises a metal plate; an anchor component affixed to the plate which is used to anchor the system in a fixed position; a battery power source mounted on or affixed to the plate; a switch and/or controller optionally mounted to the plate; and a motorized winch operatively coupled to the battery, switch, and/or controller and mounted on the plate, the winch comprising a motor or engine; a drum or winding mechanism; and a cable, rope, or the like, all positioned within an encloseable bag.

The metal plate is preferably rectangular in shape, fits inside the bag, and has attachment points for an anchor component, which protrude outside of the bag. The attachment points, in one embodiment, may take the form of a pair of protrusions, integrally formed with the metal plate, that extend outwardly through slits in the bag. The protrusions may define a hole therein, which may be used to attach a strap, cable, or the like, in order to secure the apparatus to a fixed object (such as a tree or stump, for instance). In a preferred embodiment, the metal plate is attached to the bag so that it serves as the floor of the bag for easy transport of the winch system. The winch and controller are preferably bolted to the metal plate to prevent movement and the battery is removably attached to the metal plate to allow for the interchangeability of batteries. An anchor component, such as a strap, and a switch may also be transported and stored within the bag. The bag may also define pockets for a switch, anchor strap, or other desired objects or accessories. The bag may also have handles to allow the winch system to be comfortably carried and a zipper or other means for closing the bag in order to enclose and protect the winch system. The winch system may be used independently of any additional vehicle or motorized transportation means, by a single person. The winch comprises a spool or drum around which a cable may be wrapped; a winding mechanism to wind the cable inward or feed the cable outward; and a motor that is coupled to and powered by battery. The free end of the cable may include a hook or similar attachment device for securing the cable to the item that is to be winched. Numerous winches are commercially available, and it should be understood that any suitable winch may be used as preferred by the user.

The mobile winch in a bag system further comprises a means for anchoring the system in a fixed position. This means preferably includes an anchor component such as a cable, strap, rope, or the like that may be removably affixed to the aforementioned protrusions extending from the metal plate in a location best suited for the winching operation; preferably such that the anchoring means provides a securing force that is opposite the pulling direction of the winch. This anchor component may be wrapped around or secured to a fixed object and secured to the present apparatus to stabilize the winch and maximize pulling force. In one embodiment, a heavy duty nylon strap may be removably attached to the metal plate, and may further wrap around or attach to a fixed object, like a large rock, stump or tree, in order to secure the winch system in place for a winching operation. This anchor component may be removably affixed to the metal plate with a clevis fastener, U-bolt(s), or any other suitable device.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
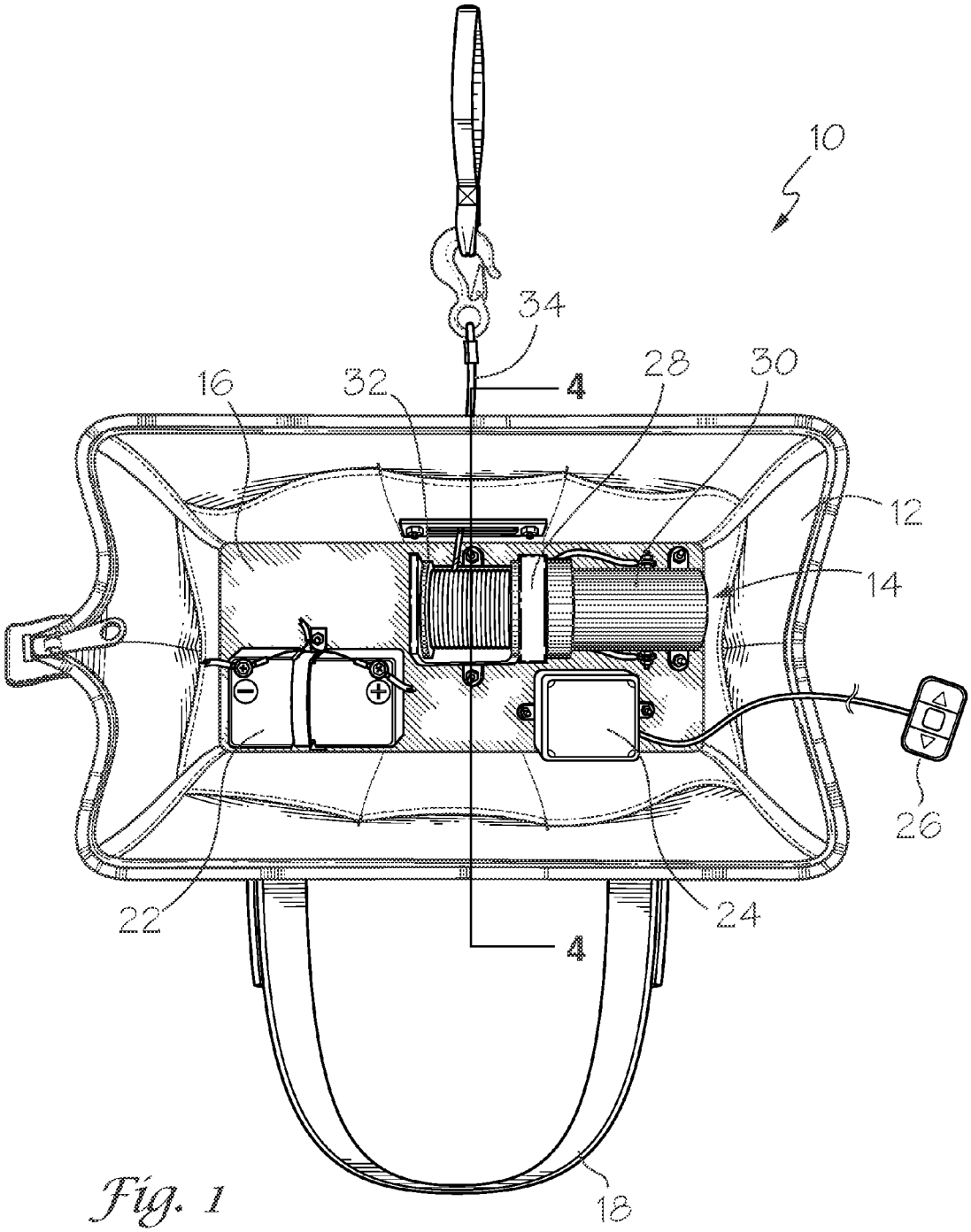
FIG. 1 is a top view of one embodiment of the mobile winch system in accordance with one aspect of the present invention.

FIG. 1 illustrates one embodiment of a mobile winch in a bag system 10 generally comprising an anchor component 18 for anchoring the system 10 in a fixed position and a bag 12 enclosing the components of the winch system 14, preferably comprising a metal plate 16 attached to the floor of the bag 12, a battery 22 mounted on or affixed to the metal plate 16, a motorized winch 28 mounted on the metal plate 16, and a controller 24 mounted on the metal plate 16.

FIG. 1 shows a generally rectangular shaped metal plate 16 inside a bag 12, the metal plate 16 acting as a base for the winch 28, a controller 24, and a battery 22. The metal plate 16 may also define attachment points 20 that protrude through slits or openings in the bag, and extend outside the bag 12. These attachment points 20 may allow connection of the anchor component 18 to the apparatus. A single person can easily move the mobile winch in a bag system 10 to any physical location required by simply transporting the bag 12. To aid in transport of the bag 12, the bag 12 may have handles, wheels, straps, or other useful items. The bag may also have zippers, buttons, or other features to aid in enclosing and securing the winch system 14 within.

In a preferred embodiment, the battery 22, controller 24, and winch 28 may be mounted to the metal plate 16 inside the bag 12. In a preferred arrangement, the winch 28 may be operatively connected to the battery 22, a controller 24, and mounted to the metal plate 16. The winch 28 may be comprised of a motor 30, winch drum 32, and winch cable 34. The winch drum 32 may be facing in an opposite direction from the attachment points 20 on the metal plate 16 such that the free end of the winch cable 34 may be pulled or extended in an outward direction relatively straight away from the winch 28 and attachment points 20. The drum 32 may have a release mechanism, so that a user can simply release the drum 32 from the gears for unspooling the cable 34 therefrom. In that case, the drum 32 must be re-engaged with the gears (taken out of "neutral") after the cable 34 has been spooled out as desired, and before commencing a winching operation.

Additionally, the bag 12 may feature an opening on the side closest to the winch drum 32 so that the winch cable 34 can be pulled through the side of the bag 12. The cable slit in the side of the bag 12 allows the winch 28 to be utilized without removal of the winch 28 or the metal plate 16 it is mounted on from the bag 12. The winch 28, controller 24, and battery 22 may be mounted or affixed to the metal plate 16 with bolts or the like. In a preferred embodiment, the battery 22 may be removably mounted to the metal plate 16 to allow the battery 22 to be replaced as necessary. Alternatively, a battery mount may be affixed to the metal plate, and the battery may be removably secured to the battery mount.

Figure 2:
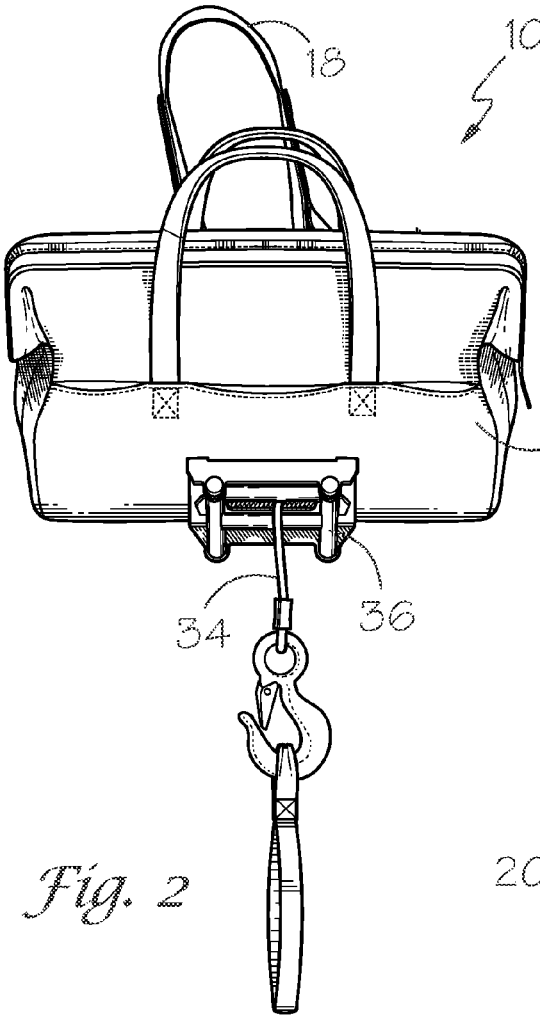
FIG. 2 is a front view of one embodiment of the mobile winch system in accordance with one aspect of the present invention.

As shown in FIG. 1, the winch 28 may include an electric motor 30, a drum/axle 32 coupled to and driven by the motor 30, and a winch cable 34 wound around the drum/axle 32. The motor 30 is electrically coupled to the battery 22. The motor 30 drives the drum/axle 32 in either direction, as desired by the user. The winch cable 34 is wound about the drum/axle 32 such that rotation of the drum/axle 32 either retracts or extends the winch cable 32 thereon, as necessary. The free end of winch cable 34 may preferably include a hook attached thereto for attaching to an object to be winched in any suitable manner. When not in use, the free end of winch cable 34 may be pulled inside of the bag 12 to prevent uncontrolled movement of the cable 34. Additionally, as in FIG. 2, a fairlead 36 may be attached to the bag 12 or to the metal plate 16, over the opening in the side of the bag 12 from which the winch cable 34 exits, in order to preserve the life of the winch cable 34 by reducing the friction of winching operations, particularly between the opening in the side of the bag 12 and the winch cable 34. As in FIG. 1, the winch 28 may be operated by a controller 24. The controller 24 may be operatively connected to a switch 26. The switch 26 may be physically attached to the controller 24, as by a cable, or may be remotely attached. The winch 28 may be any suitable winch, many of which are commercially available, such as the Badland Winches 2500 LB Capacity ATV/UTV Winch or the Rugged Ridge Extreme HD ATV/UTV Winch, for example.

Figure 3:
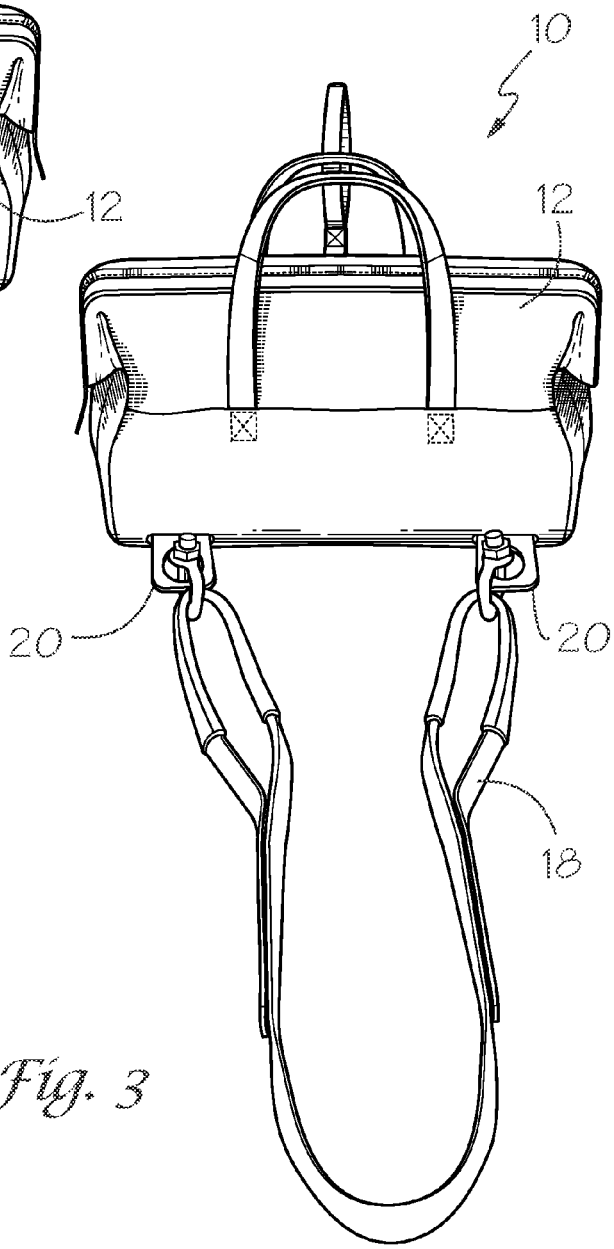
FIG. 3 is an back view of one embodiment of the mobile winch system in accordance with one aspect of the present invention.
Figure 4:
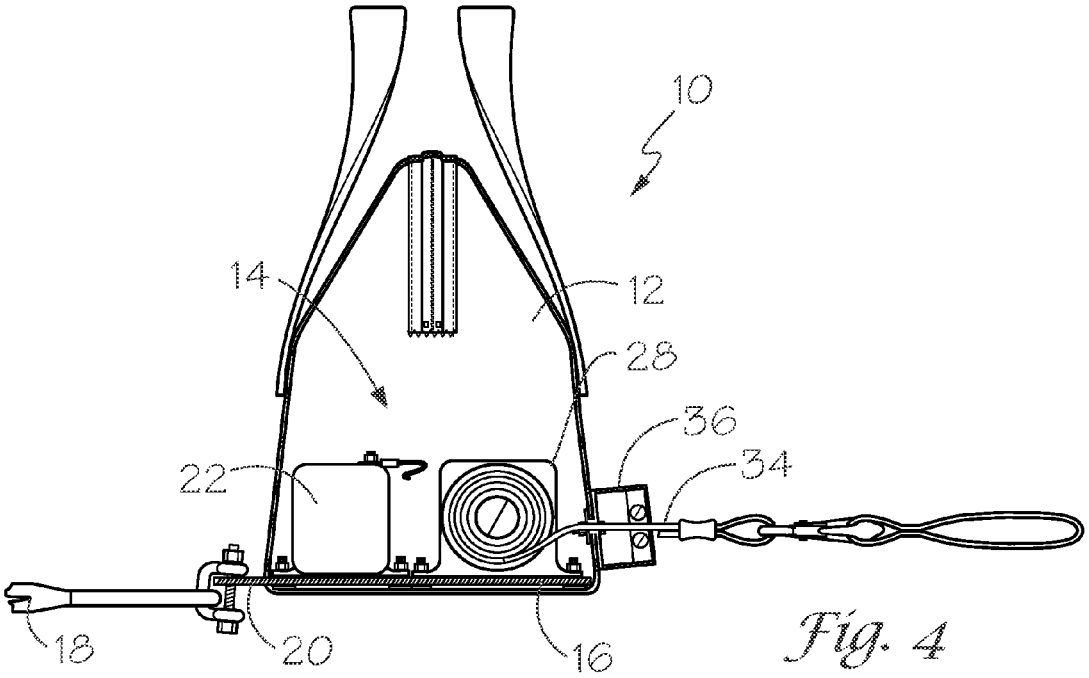
FIG. 4 is a cross sectional view at line 4-4 of the embodiment of the mobile winch system of FIG. 1.
Figure 5:
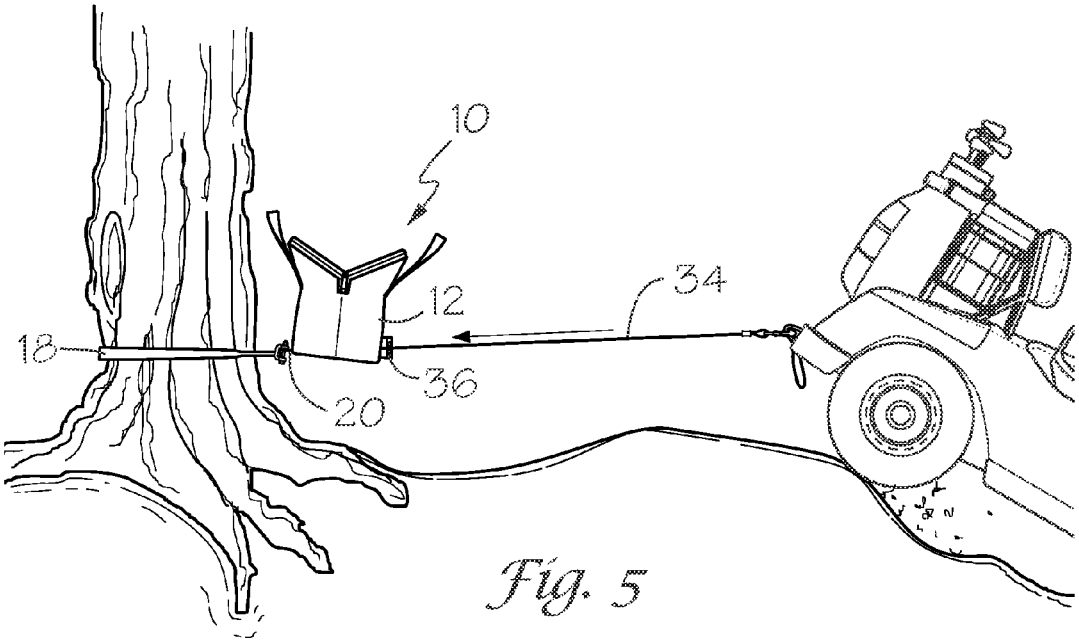
FIG. 5 is perspective view showing one embodiment of the mobile winch system in use during a winching operation, in accordance with one aspect of the present invention.

As in FIGS. 3-5, the metal plate 16 may also preferably include attachment points 20 that protrude through the bag 12 and allow attachment of an anchor component 18 for anchoring the system 10 in a fixed position. In a preferred embodiment, as shown in FIGS. 1-5, the anchor component 18 may be a tree trunk protector strap made of tough, high quality nylon, removably affixed to each lateral edge of the metal plate 16 at the attachment points 20 through the use of a clevis fastener and cotter pin. The attachment points 20 may be heavy duty metal rings welded to the metal plate 16 or may be holes defined by metal strips extending from the metal plate 16 either welded, bolted in place, integrally formed with the metal plate 16, or affixed in any suitable manner, wherein the clevis fastener 16 may be removably attached to the metal ring 18 or holes defined by the metal strips. As shown in FIGS. 3 and 5, this arrangement provides that one end of the attachment component 18 may be released from the attachment points 20 allowing the attachment component 18 to be wrapped around a fixed object and re-attached to the attachment points 20. It should be understood that other suitable removable attachment components may be utilized for anchoring the system 10 in a fixed position, as desired. Additionally, the anchor component 18 may be stored and transported within the bag 12 when not in use.

FIG. 5 illustrates the mobile winch in a bag system 10 as it may be used during operation. The system 10 may be manually transported by carrying of the bag 12 to a desired location. An important aspect of this invention is the ability to transport the winch system 10 over terrain and to locations inaccessible by current vehicle-mounted winches. During a winching operation, the anchor component 18 (strap) may be secured to a fixed object, such as a tree or stump, and the winch cable 34 may be extended outwardly and attached to the target object to be winched, as shown in FIG. 5. During the winching operation, it is noted that the system 10 may be raised from the ground as the winch cable 34 tightens. This placement depends upon the position and orientation of the end of the winch cable 34 and the anchor component 18.

It is contemplated that the winch cable 34 may also be directed upwardly, toward the top of a tree that is being cut, for instance, and then the force exerted by the winch 28 is at a downward angle toward the winch 28. In most cases, it will be necessary to use the anchor component 18 to prevent the winch 28 from moving, because otherwise, the winching operation is likely to simply move the winch system 10 toward the target object, rather than moving the target object toward the winch system 10.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What I claim is:

1. A mobile winch system comprising:

a bag having an opening that includes a closure means, said closure means allowing said opening in said bag to be in an open or enclosed position;

a metal plate having an outer face and an inner face, said outer face affixed to a bottom surface on an inner portion of said bag;

said metal plate including at least one protrusion, said protrusion defining a hole that serves as an attachment point for securing said anchoring component thereto;

a winch mounted to said inner face of said metal plate, said winch comprising a motor, a winch drum, and a winch cable attached to and wound about said winch drum, said winch cable also having a free end;

a battery removably affixed to said inner face of said metal plate for driving said motor; and an anchor component for anchoring said winch system in a fixed position, said anchor component being removably attached to said metal plate.

2. The mobile winch system of claim 1 further including a controller operatively connected to said winch for controlling operation of said winch by a switch.

3. The mobile winch system of claim 2 wherein said switch includes a length of cable attached to said controller, so that a user may operate said winch from a remote position.

4. The mobile winch system of claim 1 wherein said bag defines a hole for said free end of said winch cable to pass through.

5. The mobile winch system of claim 1 wherein said anchoring means comprises a strap.

6. The mobile winch system of claim 5 wherein said strap is affixed to said metal plate using a removable fastener.

7. The mobile winch system of claim 1 further including a hook attached to said free end of said winch cable for securing said winch cable to an object.

8. The mobile winch system of claim 1 further including a charger removably attached to said battery in order to charge said battery during periods of nonuse.

* * * * *